US011439895B2

(12) United States Patent
Stack

(10) Patent No.: US 11,439,895 B2
(45) Date of Patent: Sep. 13, 2022

(54) RING TOSS APPARATUS AND SYSTEM

(71) Applicant: Greg Michael Stack, Washington, DC (US)

(72) Inventor: Greg Michael Stack, Washington, DC (US)

( * ) Notice: Subject to any disclaimer, the term of this patent is extended or adjusted under 35 U.S.C. 154(b) by 0 days.

(21) Appl. No.: 17/109,545

(22) Filed: Dec. 2, 2020

(65) Prior Publication Data

US 2022/0168629 A1 Jun. 2, 2022

(51) Int. Cl.
*A63F 9/02* (2006.01)

(52) U.S. Cl.
CPC .... *A63F 9/0208* (2013.01); *A63F 2009/0213* (2013.01)

(58) Field of Classification Search
CPC ..... A63F 9/0208; A63F 2009/0213
USPC ..... 273/329, 331, 332, 334, 335, 336
See application file for complete search history.

(56) References Cited

U.S. PATENT DOCUMENTS 1,052,907 A * 2/1913 Furgusson ..... A63F 9/02 273/332
1,121,353 A * 12/1914 Grikscheit ..... A63F 9/02 273/332
1,398,511 A * 11/1921 Hanrath ..... A63B 67/10 273/332
1,517,454 A * 12/1924 Platt ..... A63B 67/10 273/332
1,578,142 A * 3/1926 Laskowski ..... A63B 67/00 273/332
2,147,176 A * 2/1939 Ronzone ..... A63F 9/02 273/332
2,942,886 A * 6/1960 Ackerman ..... A63B 67/10 273/332
2,950,917 A * 8/1960 Lyon ..... A63F 9/02 273/332
3,009,702 A 11/1961 Albert
3,023,001 A * 2/1962 Gourdouze ..... A63B 69/0071 473/430
3,520,535 A * 7/1970 McGlade ..... A63B 67/10 273/332
3,656,747 A 4/1972 Revell, Jr. et al.
4,564,200 A * 1/1986 Loring ..... A63B 67/10 273/332
4,635,942 A 1/1987 Flaherty, Jr.
5,171,019 A * 12/1992 Arnette ..... A63B 67/10 273/332
5,709,604 A 1/1998 Coats et al.
6,669,200 B1 12/2003 Knetsch et al.
6,857,608 B2 2/2005 Avinger
7,207,088 B2 4/2007 Adams et al.
7,967,344 B2 6/2011 Herren
7,992,833 B1 8/2011 Goodman et al.
8,011,664 B2 * 9/2011 Hilbert, Jr. ..... A63B 67/10 273/332

(Continued)

*Primary Examiner* — Joseph B Baldori
(74) *Attorney, Agent, or Firm* — Howard University School of Law

(57) ABSTRACT

A ring and hook system and apparatus includes a toss member tethered by a tether member to a collapsible armature, supported by an inverted u-shaped cantilever receiver angled at approximately 90°, which is attached to a vertical armature. A hanger on the top may be used to secure the armatures on a door and a hook which protrudes horizontally from the bottom of the vertical armature to receive the tethered toss member.

20 Claims, 5 Drawing Sheets

(56) References Cited

U.S. PATENT DOCUMENTS

| | | | | |
|---|---|---|---|---|
| 8,740,221 | B2 * | 6/2014 | Bondiskey | A63F 7/0628 273/331 |
| 10,238,221 | B2 | 3/2019 | Kressin et al. | |
| 10,981,041 | B2 * | 4/2021 | McGetrick | A63B 67/06 |
| 2009/0206550 | A1 | 8/2009 | Pershin et al. | |
| 2014/0049007 | A1 | 2/2014 | McGetrick et al. | |
| 2015/0115530 | A1 | 4/2015 | Vanston | |
| 2016/0339315 | A1 | 11/2016 | McGetrick | |

* cited by examiner

RING TOSS APPARATUS AND SYSTEM

FIELD

The present disclosures relate to systems, methods, and apparatuses of a ring toss apparatus and system.

BACKGROUND

Outdoor activities, commonly referred to as lawn games, such as horseshoes, ring toss, cornhole, lawn darts, croquet, and the like, can be found in backyards and tailgates across the country. Such activities are among the most popular of today's recreational and social activities. Not only are they a great entertainment value, they also serve to bring families and friends closer together for conversation and interaction that is just not possible when watching television, reading a book, surfing the Internet, or playing an electronic game. However, most backyard games are quickly figured out by even the youngest of players, and one quickly becomes bored.

There are numerous approaches to playing games, although most of the games utilize a series of chance features, typically being dice as the most common example of a chance feature. Thus, the typical dice or die contains six sides, in that each of the sides normally has indicia in the form of a letter or a particular number of dots indicating a number. The dice are then rolled by the player with the top side of the dice counting as letters or numbers that the player can utilize in an attempt to utilize the various indicated letters or numbers for some type of scoring scheme that eventually will lead to a game winner. One problem with existing ring toss games is that the string can become wound up over time as the ring twists and spins. This can cause the string to shorten and wear out prematurely. This can also affect the outcome of a game as the string unwinds and places unnatural spin onto the ring. Despite the developments of the traditional ring-toss systems, there have not been significant improvements.

SUMMARY

In light of the foregoing background, the following presents a simplified summary of the present disclosure to provide a basic understanding of some aspects of the disclosure. This summary is not an extensive overview of the disclosure. It is not intended to identify key or critical elements of the disclosure, or to delineate the scope of the disclosure. The following summary merely presents some concepts of the disclosure in a simplified form as a prelude to the more detailed description provided below.

The aspects of the present disclosure generally relate to an articulated portable ring toss apparatus and system. Aspects of the present disclosure include systems, apparatus, and methods of a portable articulated ring toss system that is designed to be suspended over a door or other vertical barrier or panel.

In one aspect, an articulated toss and catch apparatus, may include a hanger member with a receiver to releasably engage a planar barrier and a cantilever armature being pivotally and a slidably mounted to the hanger member. The apparatus may include a vertical armature that is mounted to the hanger member and the cantilever armature may be configured to rotate from a gaming position extending away from the hanger member to a stowage position to receive the vertical armature therein.

In one aspect, an articulated toss and catch apparatus, may include a hanger member with a receiver to releasably engage a planar barrier. The apparatus may include a cantilever armature being pivotally and a slidably mounted to the hanger member. A vertical armature may be mounted to the hanger member and a toss member may be tethered to the cantilever member. The apparatus may further include a catch-member disposed at an end portion of the vertical armature. And the cantilever armature may be configured to rotate from a first fixed position extending away from the hanger member to a second fixed position to receive the vertical armature therein.

In one aspect, an articulated ring and hook apparatus, may include a hanger member with a receiver to releasably engage a planar barrier and a cantilever armature being pivotally and a slidably mounted to the hanger member. The apparatus may include a vertical armature that is mounted to the hanger member. The apparatus may include a ring tethered to the cantilever member and a hook disposed at an end portion of the vertical armature. In this arrangement, the cantilever armature is configured to rotate from a first position extending away from the hanger member to a second position to receive the vertical armature therein.

In one aspect, the articulated ring toss system may be comprised of a unibody rectilinear armature with an articulated hanger with variable spacer. In another aspect, the articulated ring toss system may be comprised of a rectilinear armature with an open rectangle cross-section channel, an open square cross-section channel, an open trapezoidal cross-section channel, an open circular cross-section channel or an open parabolic cross-section channel, recess configured for receiving a vertical armature therein.

In other aspects, the articulated ring toss system may be comprised of a vertical armature being pivotally attached to an articulated hanger of sufficient weight to support the system with a variable spacer.

In yet other aspects, the articulated ring toss system may be comprised of a unibody rectilinear armature with an articulated hanger with a variable insert and a receiving hook.

In yet other aspects, the articulated ring toss system may be comprised of a u-shaped cantilever beam being supported by a u-cross-sectional shaped receiver which may have a pivot component that allows the beam to be rotated to a vertical resting position.

In yet other aspects, the articulated ring toss system may be comprised of a U-cross-sectional shaped cantilever beam having one or more pre-cut openings at the unhinged end for attaching a tethered ring.

BRIEF DESCRIPTION OF THE DRAWINGS

The foregoing summary as well as the following detailed description of the invention, considered in conjunction with the accompanying drawings, provide a better understanding of the disclosure, in which like reference numbers refer to like elements, and wherein.

DETAILED DESCRIPTION

In the following description of various aspects, a reference is made to the accompanying drawings to demonstrate various ways the disclosure may be used. It is understood that modifications or alternative methods may be used, but those modifications and alternatives do not detract from the present disclosure.

Figure 1:
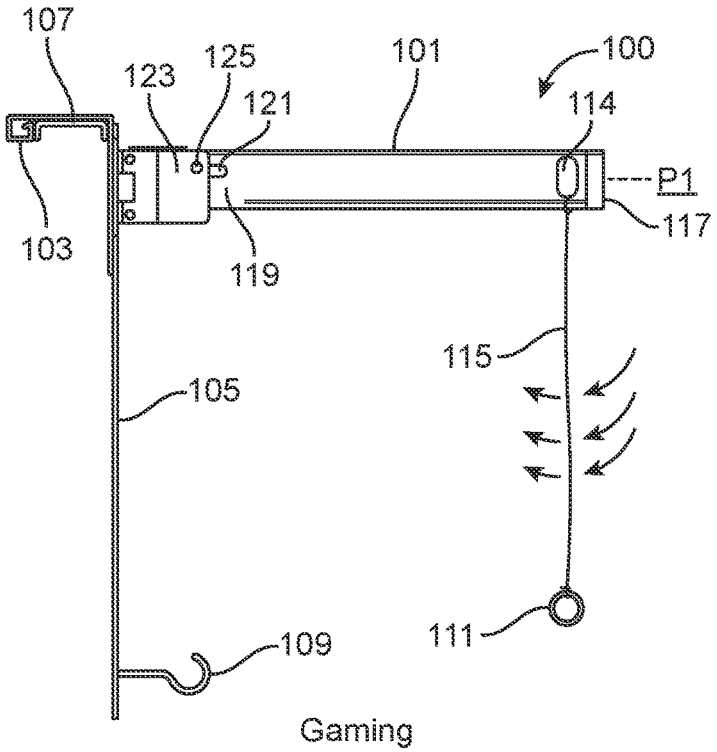
FIG. 1 depicts a side perspective view of a fully assembled articulated ring toss apparatus with a ring tethered through a hole in an armature extended horizontally, locked in an extended state by a u-cross-sectional shaped hanger and a rectilinear armature being vertically disposed with a hook at the end that may receive the tethered ring according to certain aspects of the present disclosure.
Figure 2:
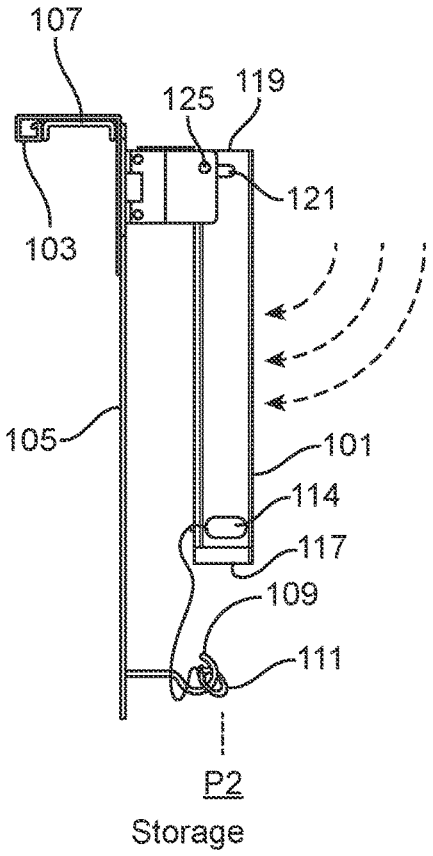
FIG. 2 depicts a side perspective view of a fully assembled articulated portable ring toss apparatus with an armature that has been pivoted and locked in a vertical position with a hole at the exposed end ring according to certain aspects of the present disclosure.
Figure 3:
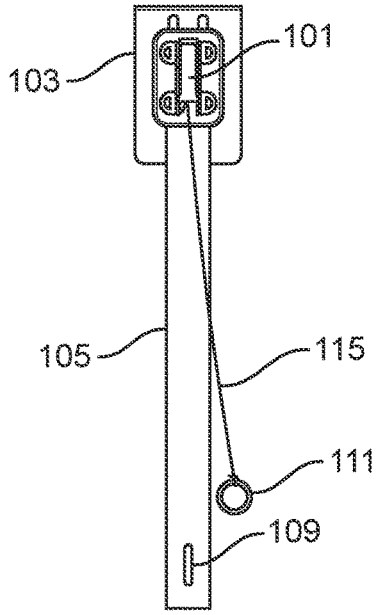
FIG. 3 depicts a front perspective view of a fully assembled articulated portable ring toss apparatus, with a ring that is tethered to a hole at the free end of an armature locked in the horizontal position that rests in an inverted u-shaped hanger and vertical armature with a hook at the end that may receive the tethered ring according to certain aspects of the present disclosure.
Figure 6:
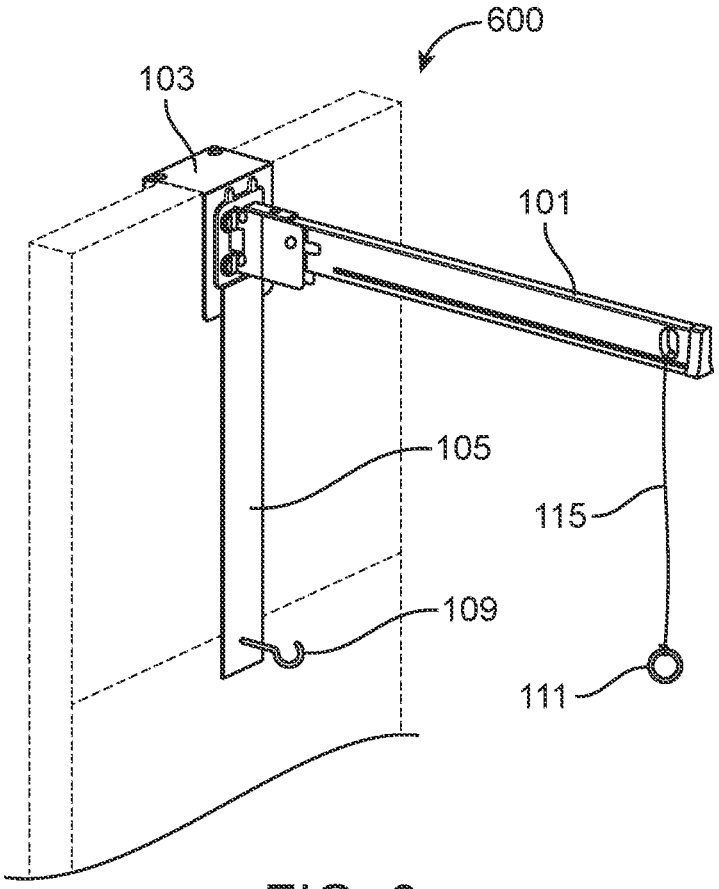
FIG. 6 depicts a perspective view of a fully assembled articulated ring portable toss apparatus with a ring tethered through a hole in invented open channel cantilever armature extended horizontally, locked in an extended state attached to hanger with variable spacer mounted over a door and a vertical armature with a hook at the end that may receive the tethered ring according to certain aspects of the present disclosure.
Figure 7:
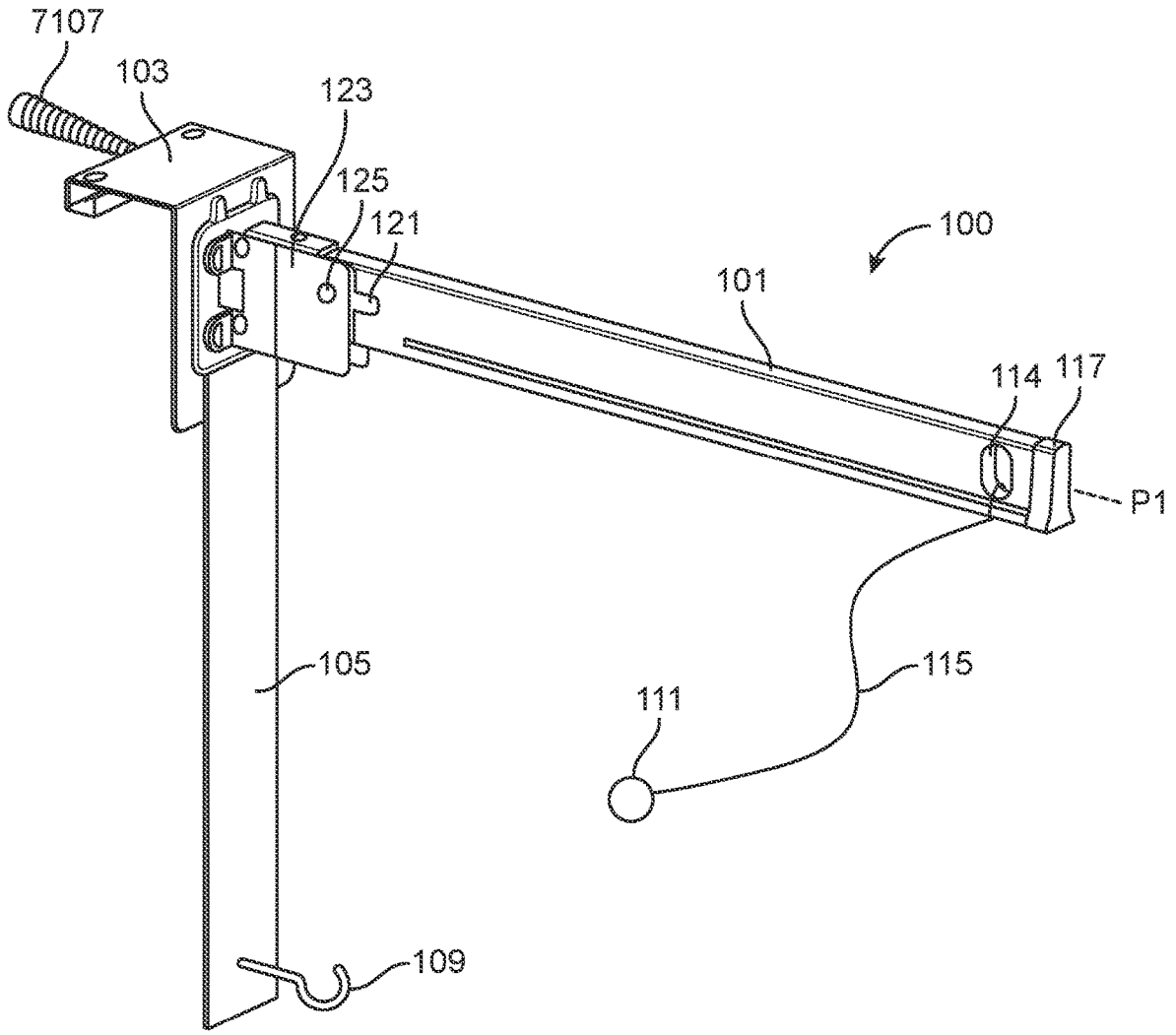
FIG. 7 is a perspective view of an articulated ring portable toss apparatus with a ring tethered through a hole in inverted open channel cantilever armature extended horizontally, locked in an extended state according to certain aspects of the present disclosure.
Figure 8:
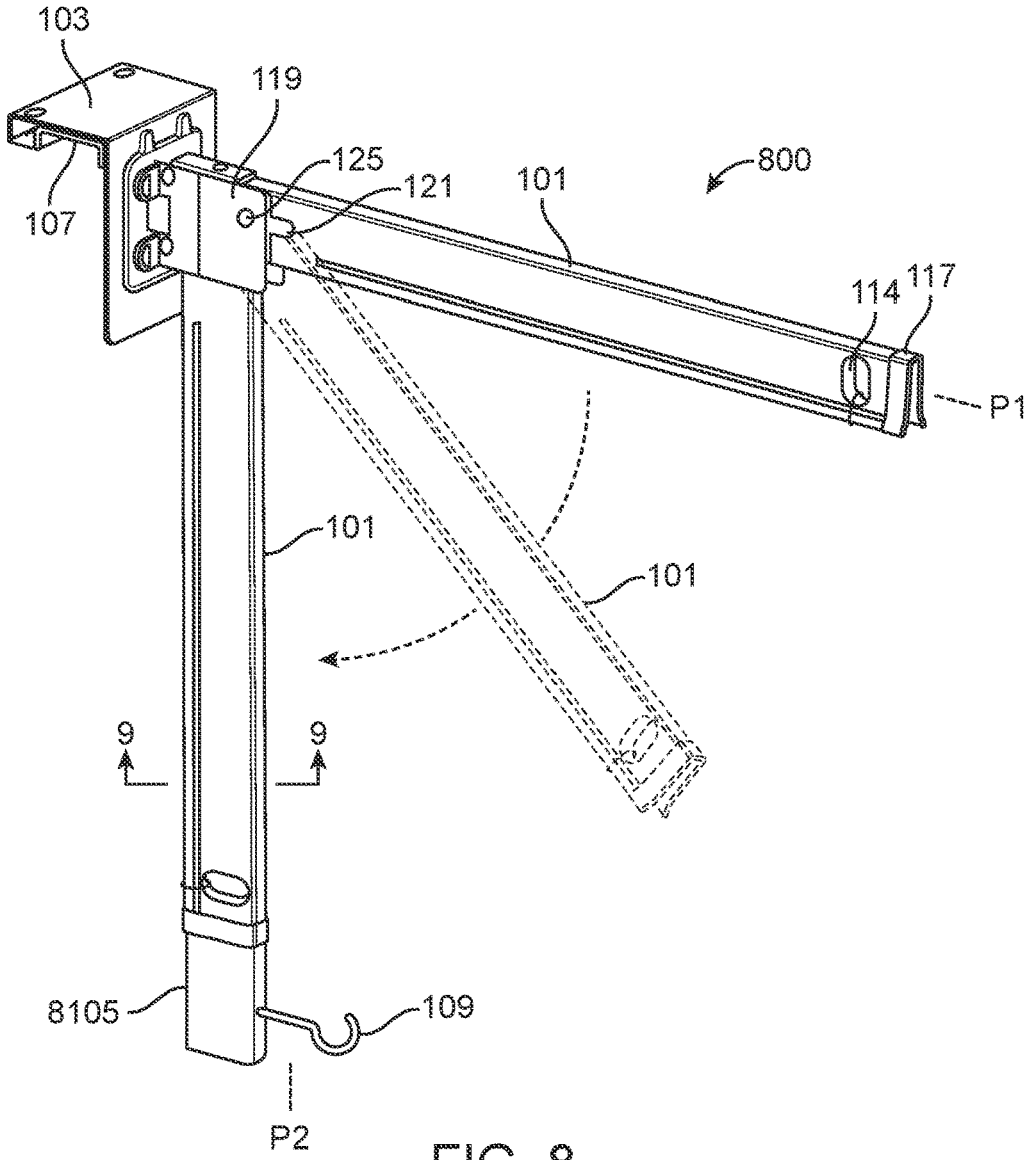
FIG. 8 is a perspective view of an articulated ring portable toss apparatus with an inverted open channel cantilever armature rotated from a horizontal position to a vertical position to engage a vertical armature to form a nested arrangement according to certain aspects of the present disclosure.
Figure 9:
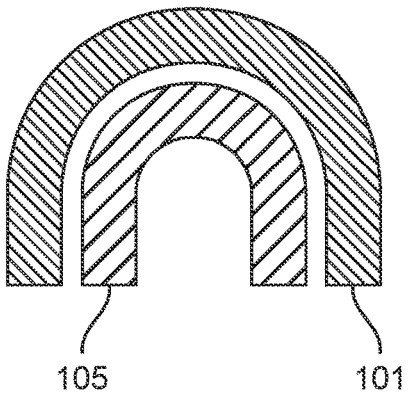
FIG. 9 is a cross-section view of the nested arrangement of taken along line 9-9 in the FIG. 8 according to certain aspects of the present disclosure.

As illustrated in FIGS. 1-10, an articulated ring toss apparatus 100 in at least one gaming position P1 shown in FIGS. 1 and 7. The apparatus 100 can be constructed to be collapsible P2, as shown in FIG. 2 and FIG. 8, to enable a horizontal armature 101 to pivot to and from a gaming position and a stowage position, respectively. Apparatus 100 may optionally have a variable spacer system 107 that enables a hanger component 103 to receive doors or vertical panels of various widths to support a weight of the apparatus 100 for the gaming position and stowage position. Articulated ring toss apparatus 100 can be of a molded configuration, metal casted or machined. Also, various parts of apparatus 100 could be made out of a plastic material in a molded configuration.

Figure 10:
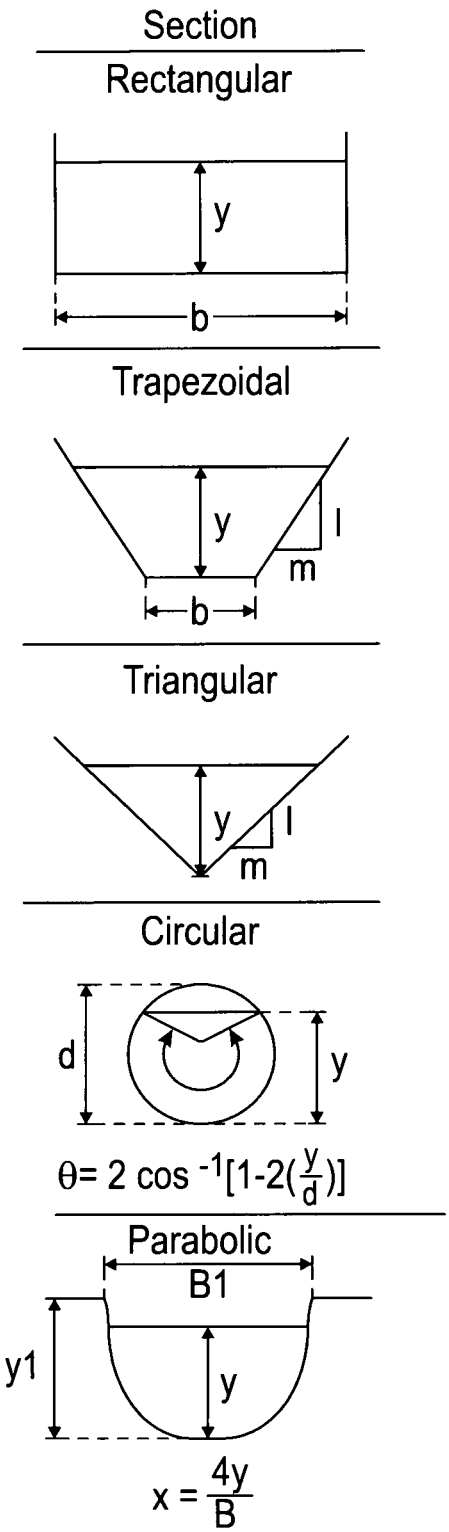
FIG. 10 depicts alternative cross-sectional shapes of the cantilever armature and vertical armature according to certain aspects of the present disclosure.

Referring to FIG. 1, the articulated ring toss apparatus 100 is shown in at least one gaming position P1. In accordance with the present disclosure, the ring toss apparatus 100 may comprise a pivotal end 119 of an inverted channel or inverted U-cross-sectional shaped cantilever armature 101 to enable the armature to rotate and lock into a horizontal gaming position to enable a tethered toss member 111 to freely swing based on a gravitation pull and/or applied external force. It should be noted that the channel shape is used herein to designate a shape that could be an invented "U", an open rectangle cross-section channel, an open square cross-section channel, an open trapezoidal cross-section channel, an open circular cross-section channel or an open parabolic cross-section channel as shown in FIG. 10.

In the construction shown in FIGS. 1-9, the tethered toss member 111 is connected by a tether member 115 attached to an exposed free end 117 of the armature 101. Nevertheless, tether member 111 can be a string, a cord, a chain, a twine, a filament, a rope, stranded, non-woven or woven elongated fibers. The toss member 111 can be of a molded plastic or metal construction such as a ring, loop, hoop, or band. The loop could be made from the material of the tethered-member 109. The description will use ring 111 for ease of explanation.

To maintain the apparatus 100 in the at least one gaming position, the pivotal end 119 of the armature 101 includes an elongated through-hole 121 (in the form of an oval racetrack shaped hole/cavity) which enables the pivotal horizontal armature 101 to be laterally extended when abutted under a flange component 123 affixed to the hanger component 103. To place in the locked gaming position, the armature 101 is slid towards the direction of the hanger flange component 123. In some constructions, the hanger component 103 and flange component 123 are unibody or one-piece molded or casted in metal or plastic. The flange component 123 includes a rod or cylinder 125 which extends through the hole 121 in the armature 101. The armature 101 is pivotally and slidably mounted in the flange component 123 via the cylinder 125 with the mating hole 121 arrangement. In one construction referring to FIG. 1, the vertical armature 105 may be affixed within the flange component 123 and the opposing free end 127 of the vertical armature 105 includes a catch-member 109 to receive the tethered ring 111. The catch-member 109 can be a hook, a nail, knob, peg and the like. In the construction shown in FIG. 1, the articulated portable ring toss apparatus 100 may be fully extended in the gaming position with the tethered ring 111 to enable a pendulum or swing motion of the ring 111 towards the hook 109 disposed on the vertical armature 105.

In one construction shown, the articulated portable ring toss apparatus 100 may comprise a variable spacer system 107 disposed in a hanger component 103 that enables the articulated portable ring toss apparatus 100 to be mounted over barriers or doors of varying widths for gaming maneuvers shown in FIG. 1, or alternatively for stowage when the apparatus 100 is placed in a collapsible position shown in FIG. 2. The variable spacer system 107 may include inserts or may connect with a threaded hole through which a large threaded screw protrudes to abut the door or barrier. In an alternative construction, the articulated portable ring toss apparatus 100 may omit the variable spacer system 107 of the hanger component 103 which may be mounted over a barrier or the door of a various predetermined widths.

Referring to FIG. 1, the articulated portable ring toss apparatus 100 is shown in the gaming position P1 in which the inverted u-shaped cantilever armature 101 is locked in the horizontal gaming position, with tethered ring 111 attached to the exposed free end 117. The horizontal armature 101 is supported on a barrier 600 by the hanger component 103, which may extend beyond the width of the armature 101 to provide a broad support base on the barrier 600.

Figure 4:
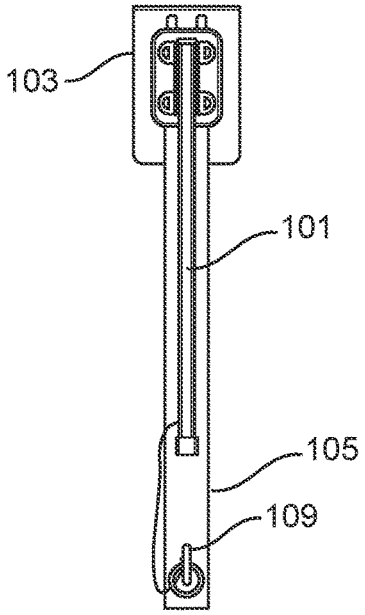
FIG. 4 depicts a front perspective view of a fully assembled articulated portable ring toss apparatus, with the horizontal armature pivoted and locked in a vertical position in which the vertical armature in received in the horizonal armature and a hook that may receive a tethered ring protruding perpendicular from the vertical armature according to certain aspects of the present disclosure.
Figure 5:
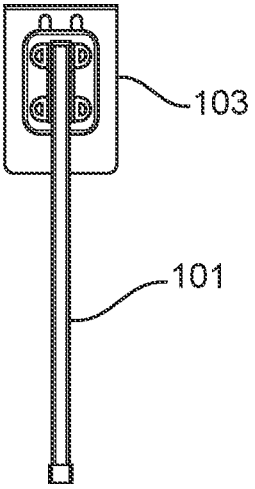
FIG. 5 depicts a top view of an articulated portable ring toss apparatus, with an armature that is extended horizontally, received by a u-shaped cantilever hanger according to certain aspects of the present disclosure.

Referring to FIGS. 4 and 8, the portable ring toss apparatus 100 is shown in a stowage position P2. In accordance with the present disclosure, the horizonal channel shaped armature 101 may be rotated downwardly clockwise towards the vertical armature 105 and locked vertically with or without a tethered ring 111 for stowage. In one construction, then cantilever armature 101 is configured to rotate from a first position P1 extending away from the hanger member 103 to a second position P2 to receive the vertical armature 105 therein to form a nested arrangement shown in FIG. 9. From the initial locked position in FIG. 1, the armature 101 is slid away from the hanger member 103 so that the pivotal end 119 become free of the upper edge of the flange component 123. This allows the armature 101 to rotate downwardly to position P2 shown in FIGS. 2 and 8. The inverted U-shaped armature 101 may be connected to articulated hanger 103 which may extend beyond the width of the u-shaped armature 101. In this construction, the vertical armature 105 with extended hook 109 may extend vertically beyond the length of the horizontal U-shaped armature 101.

Referring to FIG. 6, a fully assembled articulated portable ring toss apparatus 100 in gaming position. In accordance with the present disclosure, the articulated portable ring toss apparatus 100 is shown hanging over the door in gaming position 600, comprising a u-shaped cantilever armature in gaming position, with a tethered ring 111 attached to the exposed end, received by an articulated hanger with flange 103 to pivot an armature, which is hung over a door, abutting the vertical armature 105, with extended hook 109 at the exposed end.

In an alternative construction, the U-shaped cantilever armature 101 may be pivoted into the stowage position, with or without tethered ring 111 at the exposed end, received by an open channel rectangular or U-shaped hanger component 103, which is hung over a door, abutting the vertical armature 105 with extended hook 109 at the exposed end.

Referring to FIG. 2, a perspective view of the articulated portable ring toss apparatus 100 is shown in the stowage position 200. In accordance with the present disclosure, the articulated portable ring toss apparatus 100 comprises a u-shaped cantilever beam 101 in stowage position with tethered ring 111 attached to the exposed end and received by hook 109, received by a u-shaped cantilever with articulated hanger component 103, receiving variable spacer 107, attached to vertical armature 105 with hook 109.

In one construction, the u-shaped cantilever articulated hanger component 103 includes the flange component 123 that allows an armature 101 to pivot horizontally and vertically for gaming and stowage, respectively. In this configuration, the armature 101 is pivoted in a vertical position, with tethered ring 111 attached to the exposed end, with tethered ring 111 received by extended hook 109. Also, in this configuration, the variable spacer 107 is disposed in the hanger component 103. Nevertheless, in another configuration, the tethered ring 111 may be detached from u-shaped armature 101 and not received by extended hook 109. Also, in another configuration, the variable spacer 107 disposed in hanger 103 may be omitted.

In an alternative construction, the channel section armature 101 may be attached to a tethered ring for gaming position P1. In the alternative construction, the tethered ring may be received by extended hook 109 when the articulated portable ring toss apparatus 100 is in stowage position. In yet another construction, the vertical armature 8105 extends vertically beyond the length of armature 101 when in stowage position P2.

Some aspects of the present disclosure generally relate to an articulated portable ring toss apparatus and system can be designed to be hung over a door or other vertical barrier or panel. The apparatus 100 is a great entertainment value, that serves to bring families and friends closer together for conversation and interaction that is just not possible when watching television, reading a book, surfing the Internet, or playing an electronic game. In one method of game play, a player moves the ring 111 away for the hook 109 by tightening the string 115 to its furthest point. The player swings or tosses the ring 111 in the direction of the hook 109. To score, the ring 111 is received on the hook 109. And the process is repeated.

In some constructions, an articulated tethered ring and hook apparatus 100 may include a pivotally mounted armature 101, the armature may have a U-cross-section shaped. The u-shaped armature 101 may have of a string connection component at one end and an elongated horizontal hole at the other end that may be supported by a cantilever hanger 103. In some constructions, a U-shaped cantilever hanger 103 may include a flange that receives a u-shaped armature 101 and may allow an attached armature 101 to pivot to and from a vertical position and a horizontal position.

In some constructions, the articulated ring-and-hook apparatus 100 may include a ring 111 tethered by string 115 of sufficient length to reach the hook 109 on the vertical armature. In some constructions, a u-shaped armature extends 90° with a string attached to one end and may be supported by cantilever.

In some constructions, a cantilever hanger member 103 allows the supported horizontal armature to be collapsed vertically when not in use. In some constructions, an articulated hanger 103 may be affixed to the top of the vertical armature for hanging the apparatus vertically on a door. In some constructions, the hanger 103 may contain a variable spacer 107 to accommodate a standard or thin-depth door.

In some constructions, a ring toss system 100 may include a base 103, which mounts over a planar barrier 600. A vertical arm 105 with hook 109 may be mounted to the base and an inverted u-shaped hanger mounted on the base. A horizontal extension arm 101 may be mounted to the base and tethered ring 111. The base may have inserts 107 for mounting on variable width doors.

While illustrative apparatus, systems and methods as described herein embodying various aspects of the present disclosure are shown, it will be understood by those skilled in the art, that the disclosure is not limited to these embodiments. Modifications may be made by those skilled in the art, particularly in light of the foregoing teachings. For example, each of the elements of the aforementioned embodiments may be utilized alone or in combination or sub-combination with elements of the other embodiments. It will also be appreciated and understood that modifications may be made without departing from the true spirit and scope of the present disclosure. The description is thus to be regarded as illustrative instead of restrictive on the present disclosure.

What is claimed is:

1. An articulated ring toss apparatus, comprising:

a portable hanger member with a receiver having an inverted U-cross sectional shape configured to releasably engage a front surface, and an opposing rear surface of at least one planar barrier within the inverted U-cross sectional shape; the hanger member having an inverted U-cross sectional shaped flange disposed opposing the receiver;

a cantilever armature being pivotally and linearly slidably mounted within and to the flange of the hanger member, the cantilever armature having an inverted channel cross sectional shape along a length being defined by a proximal end at the flange extending to a distal free end of the cantilever armature;

a vertical armature being affixed to the hanger member and extending away from the hanger member;

a toss member configured to be tethered to the cantilever member; and a catch-member configured to receive the toss member therein and the catch-member being disposed at an end portion of the vertical armature;

wherein the cantilever armature includes an elongated cavity along the length;

wherein the cantilever armature is configured to slide within the flange in a rectilinear direction towards the receiver to form a locked state first position, and the cantilever armature is configured slide within the flange away from the receiver to an unlocked state so as to rotate from the locked state first position extending away from the hanger member to a second position to matingly receive the vertical armature within the elongated cavity from the proximal end to the distal free end of the cantilever armature while retaining the catch-member exposed at the end portion of the vertical armature.

2. The articulated ring toss apparatus according to claim 1, wherein the receiver further comprises a variable spacer system for engaging the at least one planar barrier.

3. The articulated ring toss apparatus according to claim 1, further comprising a pivot pin connected to the flange and the pivot pin extending through the cantilever armature; and wherein the cantilever armature is configured to rotate from the first position extending away from the hanger member to the second position to receive the vertical armature therein to form a nested arrangement.

4. The articulated ring toss apparatus according to claim 3, further comprising the cantilever armature having opposing sidewalls bounding the elongated cavity and the pivot pin extending between the opposing sidewalls.

5. The articulated ring toss apparatus according to claim 1, wherein the cantilever armature encloses a length of the vertical armature in the second position.

6. The articulated ring toss apparatus according to claim 5, wherein the vertical armature further comprises an inverted channel cross-sectional shape.

7. An articulated ring toss apparatus according to claim 1, wherein the vertical armature is perpendicular to, and extending outward from the at least one planar barrier.

8. An articulated toss apparatus, comprising:

a portable hanger member with an inverted U-cross sectional shaped receiver configured to releasably engage a front surface, and an opposing rear surface of a planar barrier; the hanger member having an inverted U-cross sectional shaped flange disposed opposing the receiver;

a cantilever armature being pivotally and linearly slidably mounted to and within the flange of the hanger member, the cantilever armature having an inverted channel cross sectional shape extending from the flange to a distal free end thereof;

a vertical armature being affixed to the hanger member;

a toss member being tethered to the cantilever member at an end opposing the hanger member; and a catch-member configured to receive the toss member therein and the catch-member being disposed at an end portion of the vertical armature;

wherein the cantilever armature is configured to slide within the flange in a rectilinear direction towards the receiver to form a locked state gaming position, and the cantilever armature is configured slide within the flange away from the receiver to an unlocked state so as to rotate from the locked state gaming position extending away from the hanger member to a stowage position so as to receive and enclose the vertical armature therein to the distal free end of the cantilever armature to form a nested configuration, while retaining the catch-member exposed at the end portion of the vertical armature.

9. The articulated ring toss apparatus according to claim 8, wherein the hanger member further comprises a variable spacer system for engaging planar barriers of varying widths.

10. The articulated ring toss apparatus according to claim 8, further comprising a pivot pin connected to the flange and the pivot pin extending through the cantilever armature.

11. The articulated ring toss apparatus according to claim 10, further comprising an elongated cavity disposed in the inverted channel cross sectional shape of the cantilever armature.

12. The articulated ring toss apparatus according to claim 8, wherein the vertical armature further comprises an inverted channel cross-sectional shape.

13. An articulated ring toss apparatus according to claim 8, wherein the vertical armature is perpendicular to, and extending outward from the planar barrier.

14. An articulated ring toss apparatus, comprising:

a portable hanger member with an inverted U-cross sectional shaped receiver configured to releasably engage a front surface, and an opposing rear surface of a planar barrier; the hanger member having an inverted U-cross sectional shaped flange disposed opposing the receiver;

a cantilever armature being pivotally and linearly slidably mounted to and within the flange of the hanger member; the cantilever armature having an inverted channel cross sectional shape along a length being defined by a proximal end at the hanger member extending to a distal free end of the cantilever armature and the cantilever armature having an elongated cavity along the length; and a vertical armature being affixed to the hanger member and extending away from the hanger member;

wherein the cantilever armature is configured to slide within the flange in a rectilinear direction towards the receiver to form a locked state gaming position, and the cantilever armature is configured slide within the flange away from the receiver to an unlocked state so as to rotate from the locked state gaming position extending away from the hanger member to a stowage position so as to receive and enclose the vertical armature within the elongated cavity from the proximal end to the distal free end of the cantilever armature to form a nested configuration.

15. The articulated ring toss apparatus according to claim 14, further comprising a toss member being tethered to the cantilever member at an end opposing the hanger member and a catch-member disposed at an end portion of the vertical armature.

16. The articulated ring toss apparatus according to claim 15, wherein the receiver further comprises a variable spacer system for engaging planar barriers of varying widths.

17. The articulated ring toss apparatus according to claim 15, further comprising a pivot pin connected to the flange and the pivot pin extending through the cantilever armature.

18. The articulated ring toss apparatus according to claim 15, wherein the elongated cavity is configured to receive the pivot pin therein.

19. The articulated ring toss apparatus according to claim 15, wherein the inverted channel cross sectional shape is selected from a group comprising one of an open rectangle cross-section channel, an open square cross-section channel, an open trapezoidal cross-section channel, or an open parabolic cross-section channel.

20. An articulated ring toss apparatus according to claim 14, wherein the vertical armature is perpendicular to, and extending outward from the planar barrier.

* * * * *